US005418995A

United States Patent [19]

Rice et al.

[11] Patent Number: 5,418,995

[45] Date of Patent: May 30, 1995

[54] SWIMMING POOL CLEANER DISCS

[75] Inventors: Chris A. Rice, Boca Raton; Desroy D. Smith, Ft. Lauderdale, both of Fla.; Robin O. Ellis, Cumnor, England; Alain J. Gazzola, Lyons, France

[73] Assignee: Zarina Holdings C.V., Amsterdam, Netherlands

[21] Appl. No.: 185,451

[22] Filed: Jan. 24, 1994

Related U.S. Application Data

[63] Continuation-in-part of Ser. No. 103,930, Aug. 6, 1993.

[51] Int. Cl.[6] ..... E04H 4/16

[52] U.S. Cl. ..... 15/1.7; 15/246; 277/212 R

[58] Field of Search ..... 15/1.7, 246, 257.01, 15/220.4, 104.061; 411/531, 533; 277/212 R, 212 C, 212 F

[56] References Cited

U.S. PATENT DOCUMENTS

| | | | |
|---|---|---|---|
| 2,215,377 | 9/1940 | Penfield et al. | 15/220.4 |
| 2,263,774 | 11/1941 | Heltzel et al. | 15/104.061 |
| 2,275,190 | 3/1942 | Lowry | 15/104.061 |
| 2,392,146 | 1/1946 | Hall | 15/220.4 |
| 2,809,387 | 10/1957 | Paiso | 15/220.4 |
| 3,902,215 | 9/1975 | Waldrop et al. | 15/220.4 |
| 4,095,378 | 6/1978 | Urakami | 15/1.7 |
| 4,152,802 | 5/1979 | Chauvier | 15/1.7 |
| 4,193,156 | 3/1980 | Chauvier | 15/1.7 |
| 4,193,469 | 3/1980 | Graf | 180/164 |
| 4,351,077 | 9/1982 | Hoffman | 15/1.7 |
| 4,530,125 | 7/1985 | Hoffman | 15/1.7 |
| 4,642,833 | 2/1987 | Stoltz et al. | 15/1.7 |
| 4,849,024 | 7/1989 | Supra | 15/1.7 |
| 4,852,211 | 8/1989 | Strausak | 15/1.7 |
| 4,949,419 | 8/1990 | Kallenbach | 15/1.7 |
| 5,014,382 | 5/1991 | Kallenbach | 15/1.7 |

OTHER PUBLICATIONS

Two photographs of a beige disc and bearing the handwritten notation "Jandy" (product shown available to Applicants no later than Jan. 23, 1994).

Two photographs of a blue disc and bearing the handwritten notation "Kreepy Krauley" (product shown available to Applicants no later than Jan. 23, 1994).

One photograph of a black disc and bearing the handwritten notation "Baracuda" (product shown available to Applicants no later than Jan. 23, 1994).

Two photographs of a blue disc for a swimming pool cleaner (product shown available to Applicants no later than Jan. 23, 1994).

*Primary Examiner*—Edward L. Roberts

*Attorney, Agent, or Firm*—Kilpatrick & Cody

[57] ABSTRACT

Discs for devices such as automatic swimming pool cleaners are disclosed. The discs includes slots (or other suitable apertures) positioned near their rimmed peripheries. The peripheries themselves, moreover, incorporate rounded edges or beads, and both the discs and associated footpads may include ramped segments facilitating movement over obstacles extending from swimming pool surfaces.

13 Claims, 2 Drawing Sheets

SWIMMING POOL CLEANER DISCS

CROSS-REFERENCE TO RELATED APPLICATION

This application is a continuation-in-part of U.S. patent application Ser. No. 08/103,930, filed Aug. 6, 1993, entitled "Swimming Pool Cleaner Discs and Associated Equipment."

FIELD OF THE INVENTION

This invention relates to discs for cleaners of liquid-containing vessels and more particularly to automatic pool cleaners having slotted discs for enhanced maneuverability in swimming pools.

BACKGROUND OF THE INVENTION

U.S. Pat. Nos. 4,351,077 to Hofmann and 4,642,833 to Stoltz, et al., incorporated herein in their entireties by this reference, disclose automatic, water-interruption-type suction swimming pool cleaners having flexible annular discs. These discs are typically mounted near the inlets of the suction cleaners and designed to contact pool surfaces when in use. By doing so, the discs decrease the tendency of the cleaners to disengage from pool surfaces, particularly when the cleaners are negotiating transition regions between walls and floors.

U.S. patent application Ser. No. 08/103,930 ("the parent-in-part application"), also incorporated herein in its entirety by this reference, describes other exemplary swimming pool cleaner discs (and associated equipment). These discs incorporate upwardly-extending, non-truncated fins protruding radially from their peripheries. The serpentine peripheries themselves, moreover, define a plurality of tongues, providing increased flexibility over even existing scalloped discs. Concurrently, the fins supply sufficient rigidity to the discs disclosed in the parent-in-part application to enable them to ride over various objects, including many drains, lights, valves, and nozzles, projecting from internal surfaces of pools.

Additional features of the discs illustrated in the parent-in-part application include curved radii between the fins and the lower surfaces of the discs, providing smooth transitions therebetween. The underside of each disc also contains an integrally-formed ramped segment surrounding the (nominally circular) central aperture of the disc. This ramp assists the pool cleaner in negotiating obstacles, supplying a smooth progression from the disc bottom to the bottom of the cleaner footpad (which the disc surrounds in use), which too may include a ramp. Multiple openings through the discs of the parent-in-part application enable fluid to pass from one surface of each disc to the other, maintaining a boundary fluid layer between the lower surface of the disc and the adjacent surface of the pool. These openings facilitate movement of the disc relative to the pool cleaner and allow dirt and debris to be entrained in the flow of fluid through the openings and in the boundary layer.

SUMMARY OF THE INVENTION

The present invention provides yet alternative flexible discs for devices such as automatic swimming pool cleaners. These discs, designed principally for use in vinyl pools, include slots (or other suitable apertures) spaced near their rimmed peripheries. These slots enhance the flexibility of the disc and, by reducing the adhesive force to which the disc is subjected, the maneuverability of an associated cleaner about the bottom surface of a pool. Cooperating with apertures located closer to the center of the disc, the slots promote more uniform removal of entrained debris as fluid passes from one surface of the disc to the other.

The discs of the present invention additionally include rounded peripheral edges to reduce the possibility of damage to, e.g., vinyl pools. A sloped region between the peripheral edge and the lower surface of each disc provides a smooth transition therebetween, facilitating lifting of the peripheral edge when encountering objects or, for example, the side walls of the pool. Raising the peripheral edge lifts the periphery of the disc off the vessel bottom until the outer edges of the slots are reached, at which point the adhesive force is substantially decreased and the cleaner more capable of maneuvering about the obstacle or wall. Consequently, the discs of the present invention reduce the possibility that their associated cleaners can wedge against the junction between the walls and bottoms of pools.

Any of these discs can incorporate an integrally-formed ramp surrounding its (nominally circular) central aperture if desired. As described in the parent-in-part application, this ramp assists the pool cleaner in negotiating obstacles, supplying a regular progression from the disc bottom to the bottom of the cleaner footpad (which the disc surrounds in use), which too may include a ramp. The sizes and spacing of slots (or other suitable apertures) near the peripheries of discs formed through, e.g., injection molding may differ as necessary to provide adequate material flow through the molds to the peripheries.

It is therefore an object of the present invention to provide a disc incorporating slots or other suitable apertures near its periphery.

It is another object of the present invention to provide a disc having a rimmed periphery with a rounded edge or bead to reduce the possibility of damage to certain fragile or easily-damaged vessels.

It is a further object of the present invention to provide a disc facilitating movement of an automatic swimming pool cleaner about the bottom surfaces and over various objects projecting from internal surfaces of pools.

It is an additional object of the present invention to provide a disc having a sloped region between its rounded peripheral edge and lower surface.

It is yet another object of the present invention to provide a disc having an underside containing a ramped segment surrounding (concentric with) its central aperture.

It is, moreover, an object of the present invention to provide a disc including multiple cooperative openings therethrough, enabling fluid to pass from one surface of the disc to the other.

Other objects, features, and advantages of the present invention will become apparent with reference to the remainder of the text and the drawings of this application.

DETAILED DESCRIPTION

Figure 1:
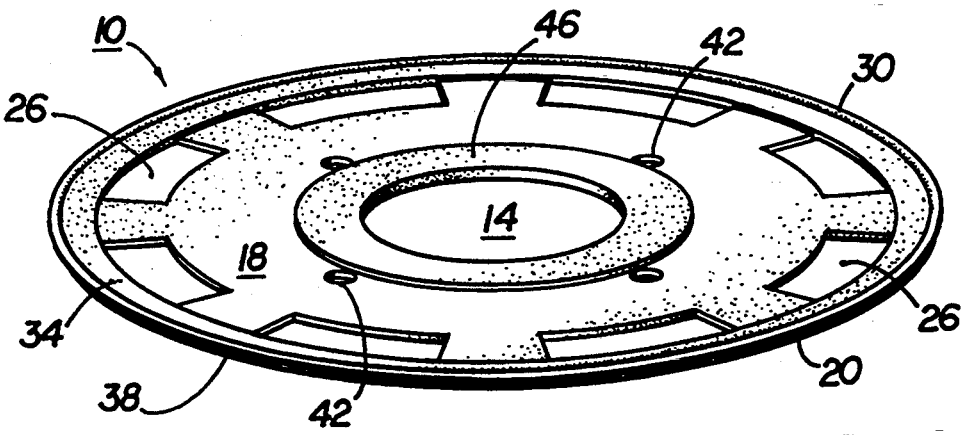
FIG. 1 is a perspective view of a disc of the present invention.
Figure 2:
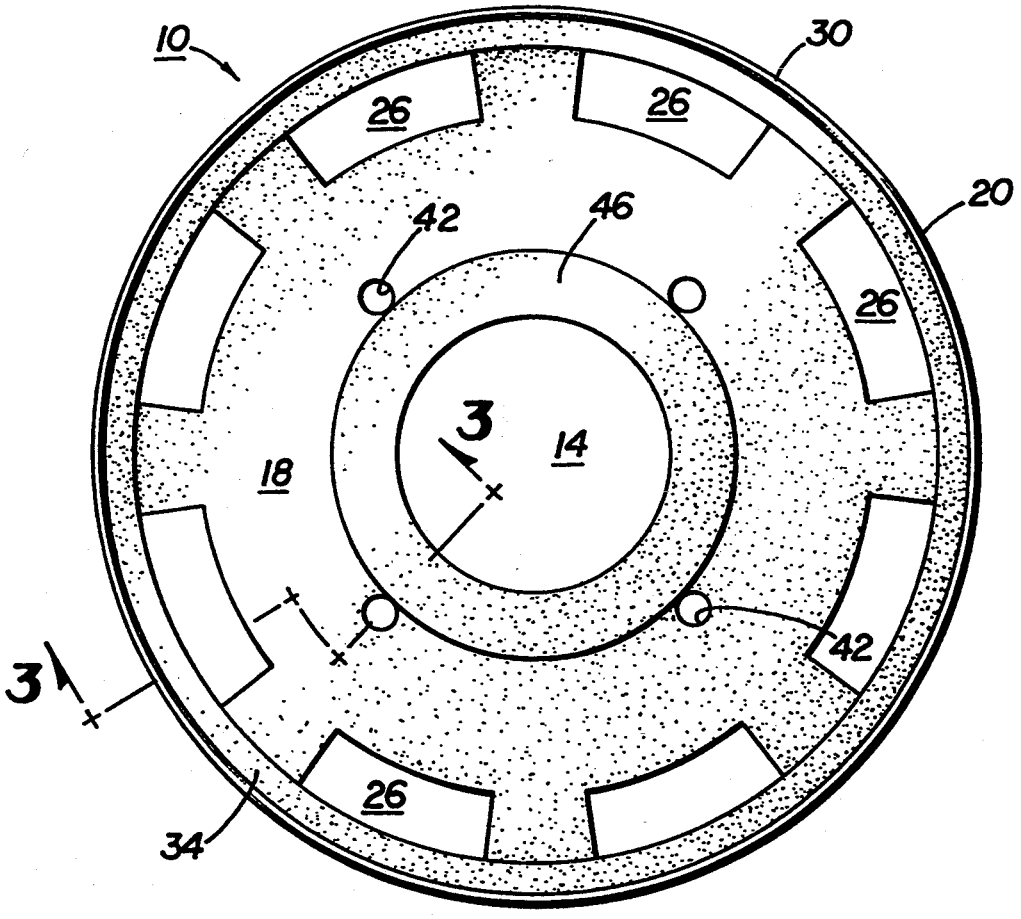
FIG. 2 is a top plan view of the disc of FIG. 1.
Figure 3:
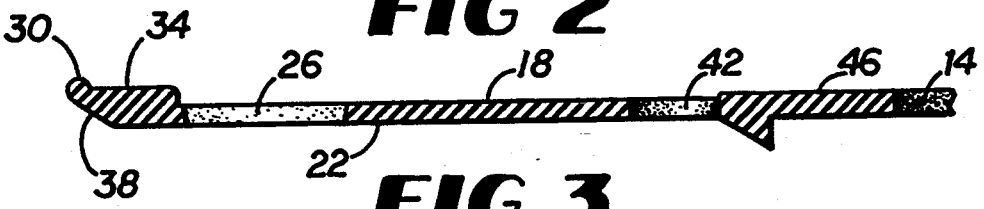
FIG. 3 is a cross-sectional view of a portion of the disc of FIG. 1 taken along lines 3—3 of FIG. 2.

FIGS. 1–3 illustrate disc 10 of the present invention. Disc 10 defines a central aperture 14, nominally circular, in which a footpad of an automatic swimming pool cleaner may be received, for example. Disc 10 also defines a generally planar upper surface 18, a periphery 20 and, as shown in FIG. 3, a lower surface 22. Spaced uniformly radially about disc 10 adjacent periphery 20 are slots 26, which extend through disc 10 from upper surface 18 to lower surface 22. Slots 26, eight of which are illustrated in FIGS. 1–2, facilitate transfer of suspended debris from upper surface 18 to lower surface 22 for removal by the automatic swimming pool cleaner. Slots 26 also increase the flexibility of disc 10.

As shown in FIGS. 1–3, periphery 20 comprises edge or bead 30, rim 34, and sloped region 38 extending between rim 34 and lower surface 22. Bead 30 is rounded to diminish the possibility of damaging fragile vessels such as pools having vinyl liners. By contrast with slots 26, rim 34, which in some embodiments may be approximately twice the thickness of the majority of disc 10, in such circumstances will make periphery 20 more rigid. If of increased thickness, therefore, rim 34 will inhibit flexing of periphery 20 when disc 10 encounters the junctures of side walls and the bottom of a swimming pool, for example.

Sloped region 38 of periphery 20 is designed to assist disc 10 in riding over obstacles (such as drains, lights, valves, and nozzles) projecting from the bottom or side surfaces of pools. Notwithstanding the increased rigidity of rim 34, sloped region 38 also facilitates lifting of periphery 20 when disc 10 encounters the side walls of a swimming pool. Upon meeting such a side wall, for example, sloped region 38 begins to raise above the bottom surface of the pool, lifting periphery 20 off the bottom surface until the outer edges of one or more slots 26 are reached. At this point, the adhesive force to which disc 10 is subjected is substantially decreased and the cleaner is more capable of maneuvering about the obstacle or wall. Combined with slots 26 and rim 34, therefore, sloped region 38 enhances the maneuverability of an automatic swimming pool cleaner by reducing the possibility that the cleaner will wedge against obstacles or the junctures of side walls and the bottom of a pool. Consequently, disc 10 is both sufficiently flexible to adhere properly to an uneven bottom surface of a pool and sufficiently inflexible to minimize the possibility of its associated cleaner becoming wedged in certain areas of the pool.

FIGS. 1–3 further illustrate intermediate openings or apertures 42. As best illustrated in FIG. 2, intermediate apertures 42 are radially misaligned with slots 26. Consequently, intermediate apertures 42 cooperate with slots 26 to promote removal of entrained debris (i.e. removal along more radii) as fluid passes from upper surface 18 to lower surface 22 of disc 10 (or vice-versa). This radial nonalignment also makes more uniform about disc 10 the adhesive force by which lower surface 22 contacts the surface of a vessel. Although the intermediate apertures 42 detailed in FIGS. 1–3 are circular, they may be shaped differently or repositioned relative to slots 26 if necessary or desired.

FIG. 3 evidences that the nominal thickness of disc 10 varies along each radius extending from the center of central aperture 14 to each point on periphery 20. In some embodiments of disc 10, its thickness at rim 34 is approximately 0.220", while the depth of slots 26 (and the thickness of the majority of disc 10 between upper surface 18 and lower surface 22) is about 0.095". Although the depth of central aperture 14 must be less than that of the corresponding groove of the footpad into which it is received to permit disc 10 to rotate, or pivot, relative to its associated cleaner, too great a disparity diminishes the effectiveness of disc 10 in use. Accordingly, disc 10 includes a central rim 46 positioned about central aperture 14 to increase the thickness of the portion received by the footpad. For example, the thickness of disc 10 at central aperture 14 is approximately 0.125", roughly only 0.015" less than the thickness of the corresponding groove on the footpad.

Also shown in FIG. 3 is ramp 50, which may be incorporated into disc 10 as desired. As with the ramp of the parent-in-part application, ramp 50 projects from lower surface 22 of disc 10 and is nominally positioned concentric about central aperture 14. Ramp 50 promotes a smooth transition between lower surface 22 and the bottom of the footpad (or other component) received by central aperture 14, facilitating unobstructed movement of a swimming pool cleaner associated with the footpad. Like ramp 50, the footpad may also include sloped outer surfaces to continue the regular transition from lower surface 22 of disc 10 to the mouth of the cleaner. By elevating a portion of disc 10 above the surface of the vessel being cleaned, ramp 50 permits a region of low pressure to be created under disc 10, thereby enhancing the adhesion of the remainder of disc 10 to the vessel surface.

Figure 4:
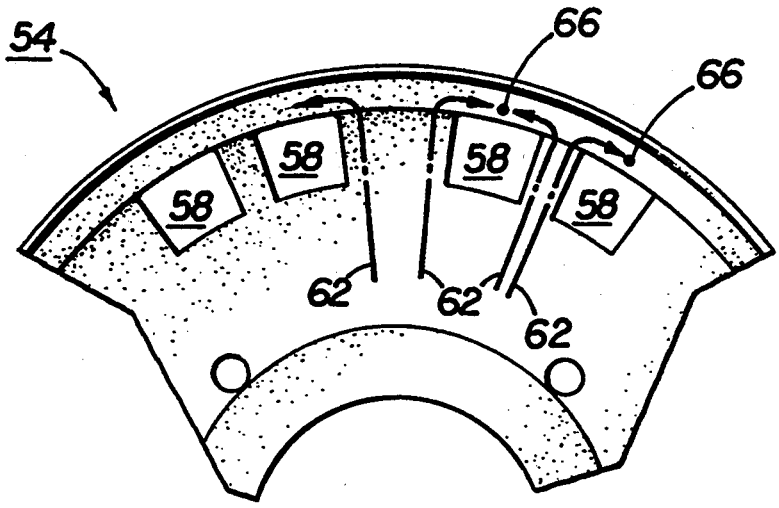
FIG. 4 is a top plan view of a portion of an alternate disc of the present invention.

FIG. 4, finally, details a portion of an alternate version of disc 10. This disc 54 includes slots 58 of different size and radial spacing than slots 26, effectively substituting two smaller apertures for each larger one in FIGS. 1–3. By doing so, disc 54 doubles (from eight to sixteen) the number of paths 62 from central aperture 14 to periphery 20 through which the material ultimately forming disc 54 (e.g. thermoset polyurethane) may flow in a mold. For injection-molded discs 54, these additional paths 62 reduce the maximum travel distance of material from central aperture 14 to the remotest portions 66 of periphery 20. This in turn reduces deformities in periphery 20 at portions 66 and increases the overall uniformity of the periphery 20. For these or other reasons slots 26 and 58 are not limited to the sizes, spacings, and shapes shown, respectively, in FIGS. 1–3 and 4, but rather may assume any characteristics suitable for their intended purposes.

The foregoing is provided for purposes of illustrating, explaining, and describing embodiments of the present invention. Modifications and adaptations to these embodiments will be apparent to those of ordinary skill in the art and may be made without departing from the scope or spirit of the invention.

What is claimed is:

1. A disc for an automatic swimming pool cleaner comprising:
   a. an upper surface;
   b. a lower surface;
   c. periphery comprising:
      i. a rim integrally formed with the upper surface; and
      ii. a semi-circular edge protruding from the rim;
   d. a plurality of apertures extending from the upper surface to the lower surface and spaced radially about the disc adjacent the periphery; and e. means for attachment to the automatic swimming pool cleaner.

2. A disc according to claim 1 in which the periphery further comprises a sloped region extending between the rim and the lower surface.

3. A disc according to claim 2 defining a central aperture for being received by a footpad of the automatic swimming pool cleaner and further comprising a central rim integrally formed with the upper surface and surrounding the central aperture.

4. A disc according to claim 3 further comprising a ramp integrally formed with and protruding from the lower surface.

5. A disc adapted for use as part of an automatic swimming pool cleaner having a footpad, comprising:

a. an upper surface;
b. a lower surface;
c. a periphery comprising:
   i. a rim integrally formed with the Upper surface;
   ii. a rounded edge protruding from the rim; and
   iii. a sloped region extending between the rim and the lower surface;
d. a plurality of apertures extending from the upper surface to the lower surface and spaced radially about the disc adjacent the periphery;
e. at least one opening extending from the upper surface to the lower surface radially intermediate the central aperture and the periphery and radially nonaligned with the plurality of apertures;
f. a central aperture for being received by the footpad of the automatic swimming pool cleaner;
g. a central rim integrally formed with the upper surface and surrounding the central aperture; and
h. a ramp integrally formed with and protruding from the lower surface.

6. A generally flexible disc adapted for use as part of an automatic swimming pool cleaner and having a first area having a selected rigidity and a periphery, comprising:

a. means for increasing the rigidity of the periphery of the disc to greater than the rigidity of the first area;
b. means for decreasing the rigidity of portions of the disc adjacent the periphery to less than the rigidity of the first area; and
c. means for attachment to the automatic swimming pool cleaner.

7. A disc according to claim 6 further having an upper surface and a lower surface and in which the rigidity-increasing means comprises:

a. a rim integrally formed with the upper surface;
b. a rounded edge protruding from the rim; and
c. a sloped region extending between the rim and the lower surface.

8. A disc according to claim 7 in which the rigidity-decreasing means comprises a plurality of generally-rectangular slots extending from the upper surface to the lower surface and spaced radially about the disc adjacent the periphery.

9. A flexible disc having a central aperture and adapted to receive a footpad of an automatic swimming pool cleaner, comprising:

a. a planar upper surface;
b. a lower surface;
c. a periphery defining (1) a rim and (2) a rounded bead extending upward from the rim;
d. a plurality of slots extending from the upper surface to the lower surface and through which fluid may pass when the automatic swimming pool cleaner is immersed in the fluid, which slots are spaced radially about the disc adjacent the periphery;
e. a plurality of axes extending radially from the central aperture to the periphery and equal to the number of the plurality of slots, each axis passing through a slot;
f. at least one opening radially interposed between the central aperture and the periphery and through which none of the plurality of axes passes;
g. a central rim integrally formed with the upper surface and surrounding the central aperture; and
h. an annular ramp integrally formed with the lower surface and concentric with the central aperture.

10. A disc according to claim 9 defining radii extending from the center of the central aperture to all points on the periphery and in which no such radius passes through both an opening and a slot.

11. A disc for a swimming pool cleaner comprising:

a. a body defining an upper surface and a lower surface and having a thickness;
b. means for attachment to the swimming pool cleaner;
c. an unbroken periphery having a thickness greater than that of the body; and
d. a plurality of apertures extending from the upper surface to the lower surface and spaced radially about the disc adjacent the periphery.

12. A disc according to claim 11 in which the attachment means comprises:

a. a central aperture; and
b. a central rim surrounding the central aperture, at least part of which has a thickness greater than that of the body and less than that of the periphery.

13. A disc according to claim 12 further comprising at least one opening extending from the upper surface to the lower surface radially intermediate the central aperture and the periphery and radially nonaligned with the plurality of apertures.

* * * * *